United States Patent [19]

Ochiai et al.

[11] Patent Number: 4,656,586

[45] Date of Patent: Apr. 7, 1987

[54] AUTOMATIC VEHICLE TESTING APPARATUS

[75] Inventors: Hajime Ochiai; Kenji Morihara; Hidetoshi Honma, all of Hyogo, Japan

[73] Assignee: Mitsubishi Denki Kabushiki Kaisha, Japan

[21] Appl. No.: 638,139

[22] Filed: Aug. 6, 1984

[30] Foreign Application Priority Data

Aug. 9, 1983 [JP] Japan ..... 58-146103

[51] Int. Cl.[4] ..... G05B 23/02; B61L 15/00

[52] U.S. Cl. ..... 364/424; 73/117.3; 246/28 F; 340/48; 340/516; 364/579

[58] Field of Search ..... 364/550, 424, 436, 426, 364/579, 580; 246/28 F, 28 R; 73/117.2, 117.3; 340/48, 516

[56] References Cited

U.S. PATENT DOCUMENTS

| | | | |
|---|---|---|---|
| 3,696,758 | 10/1972 | Godinez, Jr. | 340/48 X |
| 4,009,375 | 2/1977 | White et al. | 364/436 |
| 4,041,470 | 8/1977 | Slane et al. | 364/424 |
| 4,155,116 | 5/1979 | Tawfik et al. | 364/579 X |
| 4,266,273 | 5/1981 | Dobler et al. | 364/436 X |
| 4,279,395 | 7/1981 | Boggio et al. | 364/426 X |
| 4,330,838 | 5/1982 | Yoneda et al. | 364/580 |
| 4,361,870 | 11/1982 | D'Agostini et al. | 364/424 |
| 4,454,577 | 6/1984 | Costantini et al. | 364/550 X |

*Primary Examiner*—Gary Chin
*Assistant Examiner*—Kevin J. Teska
*Attorney, Agent, or Firm*—Sughrue, Mion, Zinn, Macpeak and Seas

[57] ABSTRACT

An automatic vehicle testing apparatus in which data representing conditions of units to be controlled are transmitted through optical transmission lines between a central station and terminal stations mounted on vehicles, which may be railroad cars. The central station can be placed in an automatic test mode. A test controller installed at a test location is operated to place the central station in the test mode. A response signal generating unit for operating each of the units in the vehicles and a monitoring unit for monitoring operations thereof are connected between each terminal station and the respective unit to be controlled. The data in the automatic test mode is transmitted through the optical transmission lines.

3 Claims, 7 Drawing Figures

AUTOMATIC VEHICLE TESTING APPARATUS

BACKGROUND OF THE INVENTION

The present invention relates to an apparatus for automatically testing vehicles.

FIG. 1 is a diagram showing the arrangement of a conventional vehicle data transmitting system, such as may be applied to a railroad train. In FIG. 1, reference numeral 1 designates a first vehicle having an operator's cab; $2^n$ through $w^4$, second vehicles having no operator's cab, the first and second vehicles being connected to one another; 3, a central station mounted on the first vehicle for transmitting data; 4, terminal stations mounted on the second vehicles for receiving data from the central station 3; 5, optical transmission lines of optical fibers connecting the central station 3 and the terminal station 4 to one another; 6, control units mounted on the vehicles 1 and $2^n$ and connected to the central station 3 and the terminal stations 4, respectively, as shown in FIG. 1; 7, a control command unit connected to the central station 3; and 8, receptacles provided on the first and second vehicles 1 and $2^n$ and connected to the control units 6.

In the conventional vehicle data transmitting system thus arranged, a control command output by the control command unit 7 is applied to the central station 3 and is then supplied through the transmission lines 5 to the terminal stations 4, and the control units 6 are operated by commands from the central station 3 and the respective terminal stations 4.

In general, equipment mounted on the train is inspected with a test device as shown in FIG. 2, which is installed at a vehicle pool where trains are gathered. In FIG. 2, reference numeral 9 designates a response signal generating unit; 10, a measuring unit, the units 9 and 10 forming a test executing unit 11; and 12, a plug connected to the test executing unit 11. The plug 12 can be connected to the receptacles 8 of the vehicles 1 and $2^n$. Further in FIG. 2, reference numeral 13 designates a test controller connected to the test executing unit.

The plug 12 of the test device shown in FIG. 2 is connected to the receptacle 8 of a selected one of the vehicles so that the test executing unit 11 is connected to the control unit 6 of the vehicle. When so connected, the test controller 13 outputs a test command specifying a test item, and the response signal generating unit 9 supplies a response signal corresponding to the command to the control unit 6. As a result, the control unit 6 is operated as required. The operation signal of the control unit 6 is measured by the measuring unit 10, and the measurement signal is processed and recorded by the test controller 13.

In the above-described method, it is necessary to connect the test executing unit 11 to each of the vehicles under test. Accordingly, the method is disadvantageous in that it takes a relatively long time to accomplish the test, and the received signal is affected by noise because the connecting line between the test executing unit 11 and the control unit 6 is relatively long; that is, it is impossible to automatically test the vehicles.

SUMMARY OF THE INVENTION

An object of the invention is to eliminate the above-described difficulties accompanying a conventional test device. More specifically, an object of the invention is to provide an automatic vehicle testing apparatus which allows the central station to operate in an automatic test mode, and in which a test controller installed at a test site is operated to cause the central station to operate in the automatic test mode, a response signal generating unit for operating a unit to be controlled and a monitoring unit for monitoring the operation thereof are connected to each terminal station and the respective unit to be controlled, and data provided in the automatic test mode is transmitted through the optical transmission lines.

DESCRIPTION OF THE PREFERRED EMBODIMENTS

Figure 1:
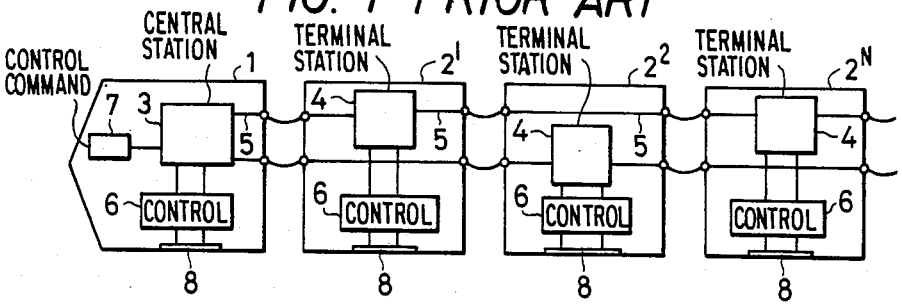
FIG. 1 PRIOR ART
FIG. 1 is an explanatory diagram showing the arrangement of a conventional vehicle data transmitting system.
Figure 2:
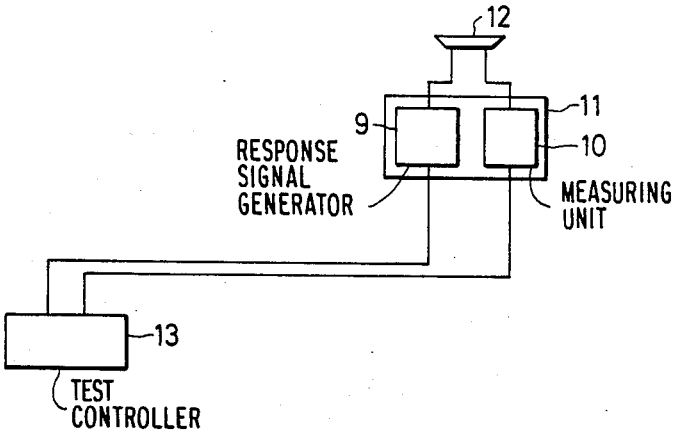
FIG. 2 PRIOR ART
FIG. 2 is an explanatory diagram showing the arrangement of a conventional test device.
Figure 3:
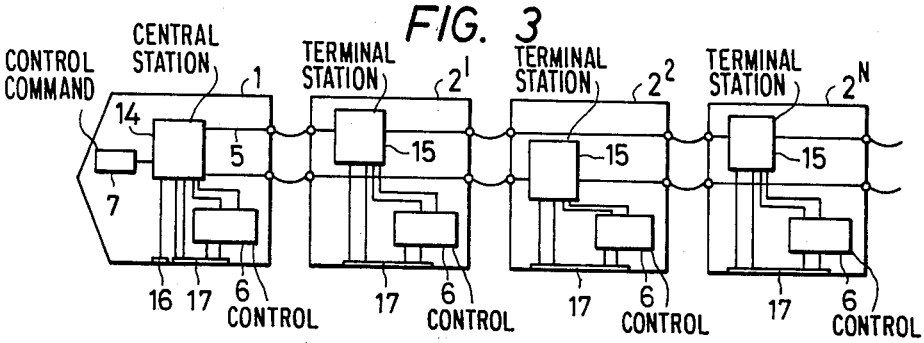
FIG. 3 is an explanatory diagram showing the arrangement of a test device constructed according to the invention.

FIG. 3 is an explanatory diagram showing the arrangement of a preferred embodiment of an automatic vehicle testing apparatus of the invention. In FIG. 3, reference numerals 1, 2, 5, 6 and 7 designate the same components as in FIG. 1 showing the conventional vehicle data transmitting system. Further in FIG. 3, reference numeral 14 designates a central station connected to the control unit 6 and the control command unit 7, the central station 14 being operated in an automatic test mode when required; 15, terminal stations connected to the control units 6 and the central station 14; 16, a receptacle provided on the first vehicle 1 and connected to the central station 14; and 17, receptacles provided on the first and second vehicles 1 and $2^n$, the receptacles 17 being connected to the central station 14, the terminal stations 15 and the control units 6. The central station 14 and the terminal stations 15 are so designed that they transmit control data to their control units 6 only when they receive control commands from the respective control command unit 7.

In the vehicle data transmitting system thus constructed, a control command output by the control command unit 7 is applied through the central station 14 to the terminal stations 15 to operate the control units 6.

Figure 4:
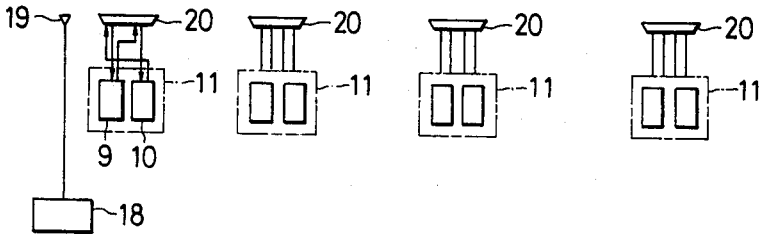
FIG. 4 is an explanatory diagram showing testing of vehicles using the arrangement of FIG. 3.

A train having the data transmitting system is sent to a vehicle pool provided with a test apparatus as shown in FIG. 4 where equipment on the vehicles is to be tested. In FIG. 4, reference numeral 18 designates a test controller; 19, a plug connected to the test controller 18; 11, test executing units each having an associated signal generating unit 9 and a measuring unit 10 the same as the conventional test executing unit; and 20, plugs connected to respective ones of the test executing units 11. More specifically, each plug 20 is so connected to the respective test executing unit 11 that the associated signal generating unit 9 receives signals and the measuring unit 10 outputs signals.

After the train shown in FIG. 3 has arrived at the vehicle pool, the control command unit 7 is turned off and other necessary actions are taken to inhibit subsequent operation. Under this condition, the plugs 19 and 20 are connected to the receptacles 16 and 17 of the vehicles 1 and $2^n$, respectively, so that the central station 14 and the terminal stations 15 are connected to the test controller 18 and the test executing units 11.

When, under this condition, test items and vehicles to be tested are specified for the test controller 18 and a test command is output, the central station, being placed in the automatic test mode, applies a test signal to the terminal stations 15 according to the test command, and the terminal stations 15 supply the test signal to the test executing units 11. As a result, the control units 6 are operated by equivalent signals provided by the equivalent signal generating units 9 to apply operating signals to the measuring units 10. The measuring units 10 process the operating signals to determine the appropriate operating conditions for the control units 6, and thereby apply the operating condition data to the respective terminal stations 15. This data is transmitted to the central station 14 and sent to the test controller 18. The data is displayed or recorded in the same manner for the test items in the test controller 18.

The control unit 6 on the first vehicle 1, which is connected to the central station 14, is tested by the latter as in the case of the control units 6 of the second vehicles $2^n$.

Figure 6:
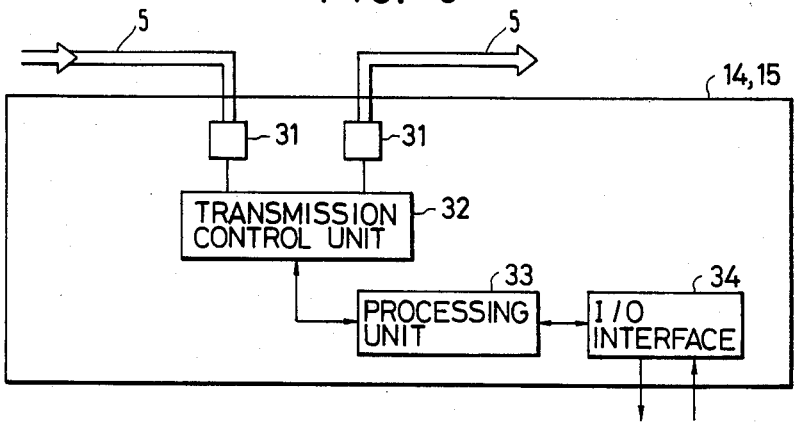
FIG. 6 is a detailed block diagram showing the structure of the central and terminal stations employed in the arrangement of FIG. 3.

FIG. 6 shows in more detail the structure of the central and terminal stations employed in the arrangement of FIG. 3. In this device, a single optical fiber which forms the transmission lines 5 is coupled through electrooptical couplers 31 to a transmission control unit 32, the latter being coupled to a processing unit 33. The processing unit 33 communicates through an input/output interface 34 with the respective control units 6.

Figure 7:
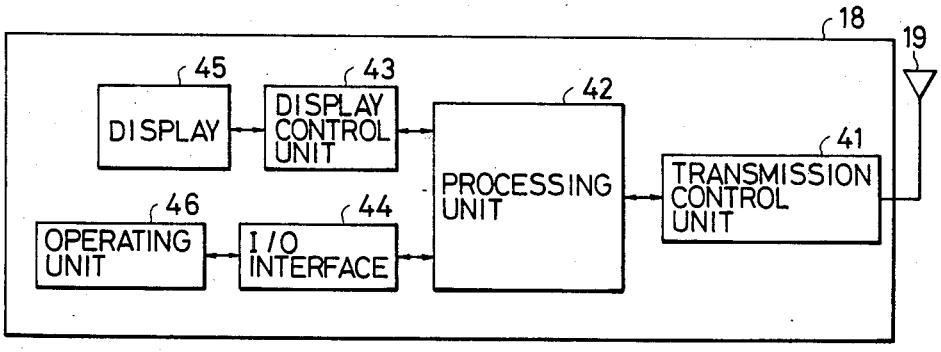
FIG. 7 is a detailed block diagram showing the structure of a test controller employed in the arrangement of FIG. 3.

Referring now to FIG. 7, there is shown therein details of the test controller 18. The test controller 18 includes an operating unit 46 communicating with a processing unit 42 via an input/output interface 44. The processing unit 42 produces data for presentation on a display 45 and communicates this data via display control unit 43. Input and output between the processing unit 42 and the plug 19 is via a transmission control unit 41.

Figure 5:
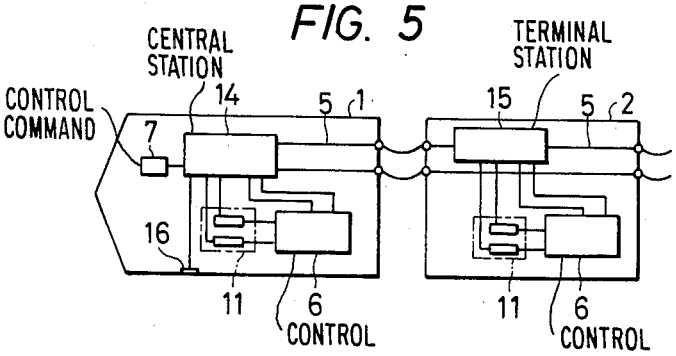
FIG. 5 is an explanatory diagram showing a second embodiment of the invention.

In FIG. 5 showing an alternate embodiment of the invention, test executing units 11 are provided on the vehicles 1 and $2^n$ so that the vehicles can be automatically tested merely by connecting the central station 14 to the test controller 18. Otherwise, this embodiment operates in the same manner as the first embodiment described above.

As is apparent from the above description, in accordance with the invention, the central station can be placed in an automatic test mode. The stationary test controller is used to place the central station in the automatic test mode, the equivalent signal generating units for operating the units to be controlled and monitoring units for monitoring operations are connected between the terminal units and the units to be controlled, and the data in the automatic test mode is transmitted through the optical transmission lines to automatically test the vehicles.

What is claimed is:

1. An automatic vehicle testing apparatus for testing control units on a plurality of vehicles, said plurality of vehicles including a first vehicle having a central station and an associated control unit and at least one second vehicle having a terminal station and an associated control unit, said control units being of the type responsive to response signals for providing operating signals as an output, said apparatus comprising:

response signal generating means at each vehicle coupled to the central or terminal station of its respective vehicle and to the control unit of its respective vehicle and responsive to a test signal for providing a response signal to said control unit;

measuring means at each vehicle, coupled to said central or terminal station of its respective vehicle and coupled to the control unit of its respective vehicle, and responsive to an operating signal output from said control unit for generating operating condition data indicative of the operating condition of its respective control unit;

first means at said central station for transmitting a test signal to each terminal station;

second means, at said central station and at each terminal station, responsive to the sending of said test signal by said first means for applying said test signal to the associated response signal generating unit, whereby each response signal generating unit provides a response signal to its associated control unit to cause said associated control unit to provide an operating signal to its associated measuring unit;

means in the terminal station at each second vehicle for receiving the operating condition data from its respective measuring unit means and for forwarding said operating condition data to said central station; and means coupled to said central station for receiving and processing said operating condition data.

2. An apparatus as defined in claim 1, wherein said last means comprises display means for displaying the operating condition data.

3. An apparatus as claimed in claim 1, wherein said response signal generating means and measuring means are selectively connectable to and disconnectable from each said vehicle.

* * * * *